United States Patent [19]

Sacre

[11] Patent Number: 4,776,109

[45] Date of Patent: Oct. 11, 1988

[54] COMFORT INSOLE FOR SHOES

[75] Inventor: Guillaume Sacre, West Linn, Oreg.

[73] Assignee: Danner Shoe Manufacturing Co., Portland, Oreg.

[21] Appl. No.: 52,552

[22] Filed: May 20, 1987

[51] Int. Cl.[4] ..... A43B 7/06; A43B 13/38

[52] U.S. Cl. ..... 36/3 B; 36/37; 36/43; 128/588

[58] Field of Search ..... 36/3 B, 3 R, 43, 44, 36/37, 80, 91; 128/588

[56] References Cited

U.S. PATENT DOCUMENTS

| | | | |
|---|---|---|---|
| 1,809,323 | 6/1931 | Williams, Sr. | 36/3 R |
| 1,845,681 | 2/1932 | Read | 128/588 |
| 2,213,770 | 9/1940 | Sajdak | 36/3 B |
| 3,624,930 | 12/1971 | Johnson et al. | 36/43 |
| 3,780,742 | 12/1973 | Madgy | 128/588 |
| 4,063,371 | 12/1977 | Batra | 36/3 B |

FOREIGN PATENT DOCUMENTS

| | | | |
|---|---|---|---|
| 550079 | 12/1959 | Belgium | 36/3 R |
| 1026777 | 2/1953 | France | 36/3 R |
| 888065 | 8/1953 | Fed. Rep. of Germany | 128/588 |
| 3232019 | 3/1984 | Fed. Rep. of Germany | 36/91 |
| 192694 | 11/1937 | Switzerland | 128/588 |

*Primary Examiner*—James Kee Chi

*Attorney, Agent, or Firm*—Eugene M. Eckelman

[57] ABSTRACT

A comfort sole arranged to be mounted in a shoe extends from the heel portion of the shoe to approximately the arch. The sole has a resilient upward curved portion intermediate the sides thereof in the area of the heel portion to form an air chamber between it and the sole of the shoe. This curved portion is arranged to flex up and down due to lifting and lowering of the person's foot while walking or running to pump air from the air chamber around the foot. The comfort sole has a cross sectional shape including thickened side portions which provide good fit and good support of a person's foot. A portion of the shoe may be recessed under the upward curved portion to increase the size of the air chamber.

2 Claims, 1 Drawing Sheet

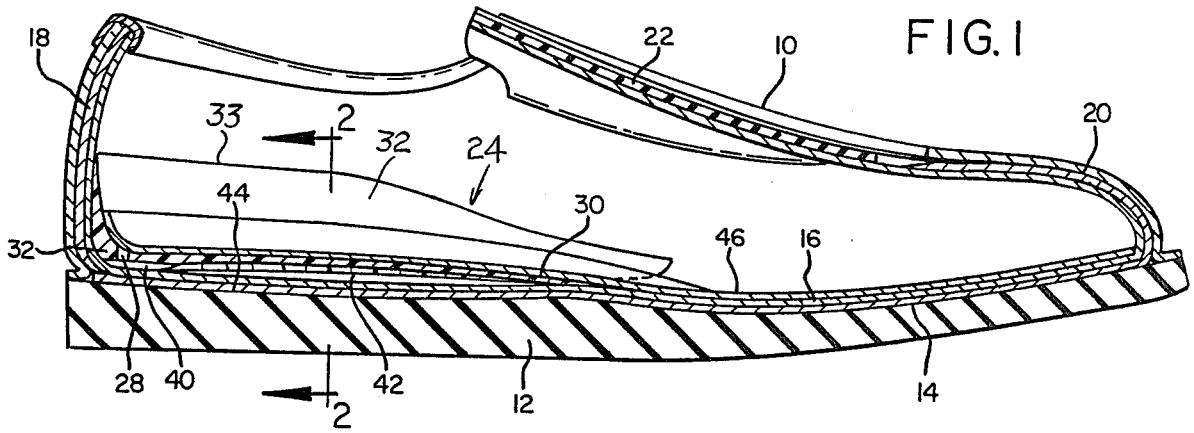
FIG. 1
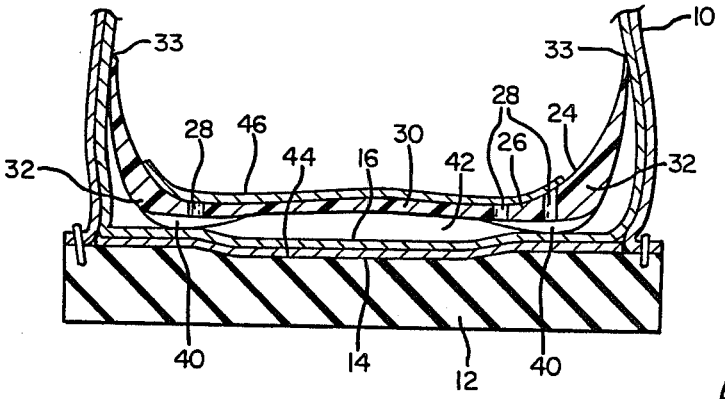
FIG. 2
FIG. 3
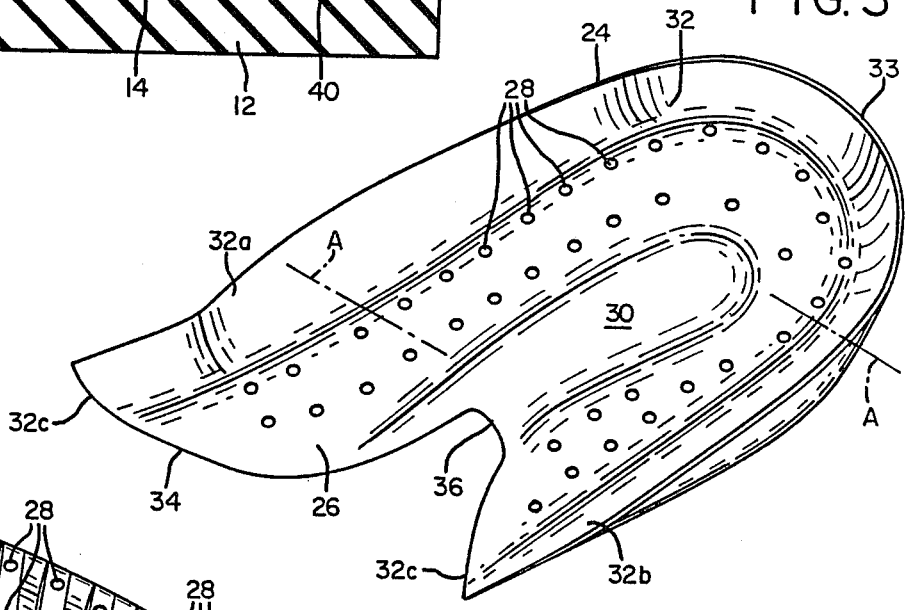
FIG. 4
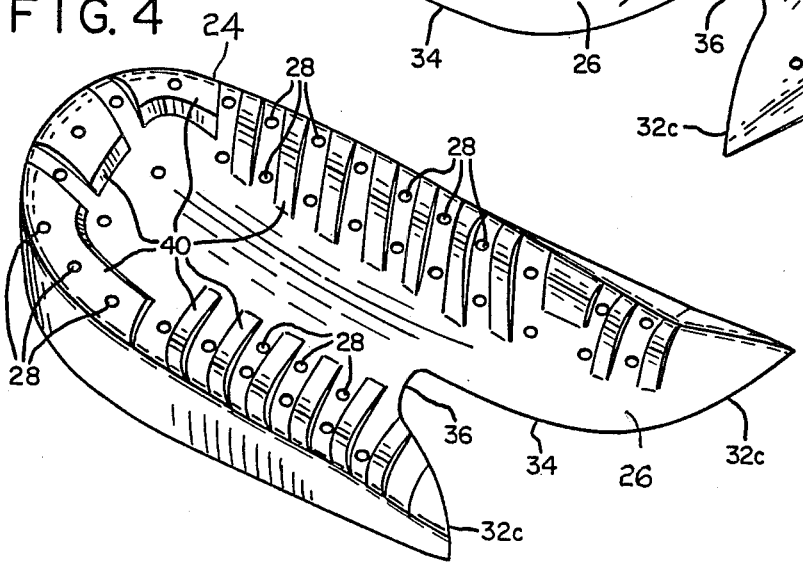

COMFORT INSOLE FOR SHOES

BACKGROUND OF THE INVENTION

This invention relates to new and useful improvements in insole constructions for shoes.

One of the sources of discomfort when wearing shoes is caused by wetness resulting from perspiration. Such can cause odor, blisters, and other discomforts, and is due to the lack of air circulation around the lower portion of the foot. Another source of discomfort results from the impact to which the foot is subjected when a person walks or runs. This latter source of discomfort is of course worse for runners and can extend fully up the legs to the hips. Still another source of discomfort is caused by the lack of arch support.

SUMMARY OF THE INVENTION

According to the present invention and forming a primary objective thereof, a comfort insole is provided that circulates air around the foot when the person walks or runs and in addition provides arch support as well as a cushion for the foot to reduce or eliminate damaging impact to the foot or other parts of the body.

A more particular object of the present invention is to provide a comfort insole for shoes occupying the area between the heel and the arch of the shoe and having an upwardly curved portion intermediate the sides in the area of the heel to form an air chamber therebelow and arranged to flex up and down when the person walks or runs, and further including passageway means therein arranged to direct pumped air to the foot.

In carrying out the above objectives, the invention comprises an inner sole member arranged for combination with a shoe and extending from the heel of the shoe to approximately the arch. The present insole has a resilient upward curved portion intermediate the sides thereof in the area of the heel to form an air chamber between it and a lower sole of the shoe. The upward curved portion of this insole is arranged to flex up and down when the person walks or runs whereby to pump air from said air chamber. Air passageway means are provided in the insole in an arrangement to direct pumped air upwardly to and around the person's foot. Rib means are provided on the bottom of the insole for circulation of air upwardly and outwardly. Structure of the insole also circulates air forwardly of the foot and in addition the insole has a novel cross sectional shape providing good fit for the bottom portion of the foot and good support. The insole may comprise a permanent part of the shoe or it can comprise a removable insert. Also, associated sole portions of the shoe have an opposed recessed portion under the upwardly curved portion of the present insole to form a portion or enlargement of the air chamber.

The invention will be better understood and additional objects and advantages will become apparent from the following description taken in connection with the accompanying drawings.

BRIEF DESCRIPTION OF THE DRAWINGS

FIG. 1 is a longitudinal sectional view taken centrally through a shoe and showing application of the present comfort insole thereto;

FIG. 2 is a cross sectional view taken on the line 2—2 of FIG. 1;

FIG. 3 is a top perspective view of the insole of the present invention; and

FIG. 4 is a bottom perspective view.

DETAILED DESCRIPTION OF A PREFERRED EMBODIMENT

With particular reference to the drawings, and first to FIGS. 1 and 2, a shoe construction is illustrated comprising a foot receiving portion 10, referred to as the upper, an outsole 12 secured to the upper and an insole 14 secured to the outsole. The shoe may also have an inner lining 16, a heel counter 18 and a toe counter 20, as well as an elastic or lace front portion 22 allowing insertion or removal of the foot from the shoe.

The present invention comprises an insole or inner sole member 24 of the shape best shown in FIGS. 3 and 4. It has a body portion 26 with a plurality of apertures 28 disposed in an outer area thereof and outwardly from an upwardly curved or pump portion 30.

The outer edges of the body portion 26 are thickened, as designated by the numeral 32. These thickened outer portions 32 are curved upwardly in a gentle curvature and terminate in a top thin edge 33 which blends smoothly into the inner surface of the shoe. These curved portions are constructed to fit comfortably a person's foot seated thereon. Also, with relation to the particular shape and construction of the sole member 24, one side of the thickened portion, designated by the numeral **32*a*, extends forwardly to the front of the arch of the foot. The other side, designated by the numeral 32*b*, is shorter in length. Each of the two portions 32*a* and 32*b* tapers in a front portion thereof to a thin front edge 32*c*. As best seen in FIG. 2, the right side in this figure, comprising the arch support side, is of thicker construction than the other side, this greater thickening extending around the heel and into the main portion of the arch for good foot support. The broken lines A in FIG. 3 designate approximately the forward ends of the thicker side portions, and from such points forward these side portions taper to the thin edge 32*c*. Thus, the wall portions 32 to the rear of points A—A have the thickness designated on the right side of FIG. 2**, and the forward portions taper to the thin front edges.

As stated above, the side **32*a* of the insole is longer than the side 32*b*. Forming a part of the present invention and as will later be more apparent, the front edge 34 angles across from the long side at approximately midway of the shoe and is notched rearwardly at 36, such notch extending to the upward curved portion 30**.

The bottom surface of the sole member 24 includes ribs 40 which extend inwardly from the sides. Most of these ribs are between sets of the apertures 28, although at the rear of the sole apertures may pass through the ribs. These ribs space the bottom surface of the sole member 24 above the supporting sole of the shoe whereby air can circulate upwardly through the apertures 28 as well as outwardly.

The sole member 24 is constructed of a sturdy but somewhat flexible and resilient material such as rubber or plastic. Its construction is such that the outer thickened portions 32 form a good fit on the foot and also good support on the bottom of the foot and arch. The upward curved or pump portion 30, however, is thin enough to be flexible and resilient and will flex up and down when a person lifts and lowers his or her foot while walking or running. The area under the upward curved portion 30 comprises an air chamber 42 and the up and down movement of such curved portion pumps air upwardly through the apertures 28 as well as around the sides of the member 24. Also, since the front notch 36 extends rearwardly to the curved portion 30, air will be pumped forwardly of the foot.

With particular reference to FIG. 2, the sole portions 12 and 14 of the shoe may be recessed at 44 in the area under the upward curvature 30, and such will increase the size of the air chamber 42 and greater air circulation is accomplished.

According to the present invention, a comfort insole is provided that causes air to circulate relative to the foot, namely, upwardly to the foot, around the sides, and toward the front. The present sole member, due to its curvature, provides a good fit and support for the foot. It can be secured in the shoe if desired or it can comprise an insert which is merely fitted in the shoe. In a preferred arrangement, an air permeable liner 46 is fitted in the shoe to overlie the comfort sole.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A shoe construction comprising:

an upper arranged to receive the foot of a person and having toe, heel and side portions including an arch receiving portion on one of said side portions;

first sole means associated with said upper;

and inner firm sole means on said first sole means extending from the heel of said upper to a forward point and having front, rear, and inner and outer side portions, the rear and side portions of said inner sole means being curved upwardly in reinforced portions to form support for the heel and side portions of the foot, said inner side portion being extended forward relative to the outer side portion for extending into said arch receiving portion approximately midway of said first sole means and providing an arch support for the foot, the front portion of said inner sole means terminating in a thin edge which angles across from said outer side portion to said extended arch supporting inner side portion, said inner sole means having a longitudinal resilient upward curved portion intermediate the sides thereof of the area of the heel portion forming an air chamber between it and said first sole means, a rearwardly extending notch in said front edge of said inner sole means intermediate the side portions, said upwardly curved portion being arranged to flex up and down due to lifting and lowering of the person's foot while walking or running to pump air from said air chamber, and apertures in said inner sole means communicating with said air chamber and directing pumped air upwardly to a person's foot, said notched front edge of said inner sole means communicating with said air chamber and directing pumped air to forward portions of the foot.

2. An insert for use with a shoe of the type arranged to receive the foot of a person and having toe, heel, and side portions and also having a sole portion and an arch receiving portion on one of said portions, said insert comprising:

an inner firm sole arranged to be mounted in a shoe and when mounted therein it extends from the heel portion to approximately the arch receiving portion, said inner sole having front, rear, and inner and outer side portions, the rear and side portions of said inner sole being curved upwardly in reinforced portions to form support for the heel and side portions of the foot, said inner side portion being extended forward relative to the outer side portion for extenting into said arch receiving portion approximately midway of the sole portion of the shoe and providing an arch support for the foot, the front portion of said inner sole terminating in a thin edge which angles across from said outer side portion to said extended arch supporting inner side portion, said inner sole having a longitudinal resilient upward curved portion intermediate the sides thereof in the area of the heel portion and arranged to form an air chamber between it and the sole portion of a shoe, a rearwardly extending notch in said front edge of said inner sole intermediate the side portions, said upwardly curved portion being arranged to flex up and down to lifting and lowering of the person's foot while walking or running to pump air from said air chamber, and apertures in said inner sole communicating with said air chamber and directing pumped air upwardly to a person's foot, said notched front edge of said inner sole communicating with said air chamber and directing pumped air to forward portions of the foot.

* * * * *